United States Patent [19]

Williams

[11] 4,354,994

[45] Oct. 19, 1982

[54] SPINNING PROCESS FOR ANTIMONY OXIDE/HALOGENATED AROMATIC POLYESTER COMPOSITION

[75] Inventor: Albert G. Williams, West Orange, N.J.

[73] Assignee: Celanese Corporation, New York, N.Y.

[21] Appl. No.: 208,203

[22] Filed: Nov. 19, 1980

[51] Int. Cl.[3] ..... D01D 1/10

[52] U.S. Cl. ..... 264/169; 264/205; 264/211

[58] Field of Search ..... 264/176 F, 205, 169, 264/211; 528/190, 193; 260/29.6 AB, 40 R

[56] References Cited

U.S. PATENT DOCUMENTS

| | | | |
|---|---|---|---|
| 3,852,401 | 12/1974 | Suzuki et al. | 264/182 |
| 4,128,614 | 12/1978 | Gilbert | 264/205 |
| 4,143,031 | 3/1979 | Ciaperoni et al. | 528/190 |
| 4,169,876 | 10/1979 | Irwin | 264/182 |
| 4,224,433 | 9/1980 | Calundann et al. | 528/190 |
| 4,285,900 | 8/1981 | Cazzaro et al. | 264/182 |

*Primary Examiner*—Jay H. Woo

*Attorney, Agent, or Firm*—Burns, Doane, Swecker & Mathis

[57] ABSTRACT

An improved process for spinning a composition comprising halogenated aromatic polyesters and an oxide of antimony is disclosed. The process comprises spinning the composition through a spinneret having one or more holes which have a diameter of from about 60 to about 200 microns.

9 Claims, No Drawings

SPINNING PROCESS FOR ANTIMONY OXIDE/HALOGENATED AROMATIC POLYESTER COMPOSITION

BACKGROUND OF THE INVENTION

Halogenated aromatic polyesters, such as the condensation product of 4,4'-isopropylidene-2,2',6,6'-tetrachlorodiphenol or 4,4'-isopropylidene-2,2',6,6'-tetrabromodiphenol with isophthalic acid and/or terephthalic acid or the ester forming derivatives thereof, have been used to produce a number of inherently non-burning fibrous materials which are particularly advantageous when fibrous articles are required for use in fire-control environments, such as children's sleepware, suits for fire fighters, hospital furnishings, and uniforms for military and civilian personnel.

These polyesters are frequently used in combination with an oxide of antimony, i.e., either antimony trioxide or antimony pentoxide, to form a flame retardant fiber composition. However, when such antimony oxides are mixed with the halogenated aromatic polyesters, the antimony oxide containing polyester composition becomes difficult to spin because of clogging of the holes of the spinneret.

When "Nyacol" antimony pentoxide, a very small particle size (15–50 millimicrons) colloidal antimony pentoxide produced by Nyacol Inc., is employed in the polyester composition, there is substantially no clogging problem. However, this particular colloidal antimony pentoxide contains an Ethomeen dispersion stabilizer. This stabilizer is a polyethoxylated aliphatic amine which will decompose the halogenated aromatic polyester when it is hot drawn. As presently known, there is no such colloidal antimony pentoxide which can be prepared without a dispersion stabilizer which will decompose the halogenated aromatic polyester when it is hot drawn.

The search has continued for improved processes for spinning compositions of an oxide of antimony and halogenated aromatic polyester. This invention was made as a result of that search.

OBJECTS AND SUMMARY OF THE INVENTION

Accordingly, a general object of the present invention is to avoid or substantially alleviate the above problems of the prior art.

A more specific object of the present invention is to provide an improved process for spinning compositions comprising an oxide of antimony and halogenated aromatic polyester into fibers.

Another object of the present invention is to provide an improved process for spinning compositions comprising an oxide of antimony and halogenated aromatic polyester into fibers such that the fibers produced may be hot drawn without decomposition.

Other objects and advantages of the invention will become apparent from the following summary and description of the preferred embodiments of the present invention.

The present invention provides an improved process for spinning a composition comprising an oxide of antimony and halogenated aromatic polyesters into fibers. This process comprises spinning the composition through a spinneret having one or more holes which have a diameter of from about 60 to about 200 microns.

DESCRIPTION OF THE PREFERRED EMBODIMENTS

Halogenated aromatic polyesters have recurring units of the structural formula:

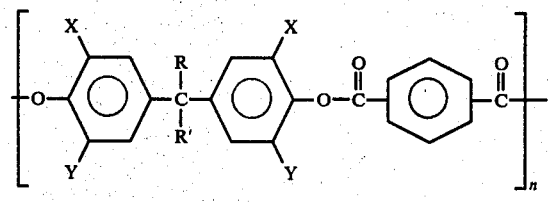

wherein X, which may be the same or different, may be chlorine or bromine, Y, which may be the same or different, may be hydrogen, chlorine, or bromine, R and R' may be the same or different and represent lower alkyl groups (e.g., having from 1 to about 5 carbon atoms), hydrogen, or together constitute a cyclic hydrocarbon group, and n equals at least 10 (e.g., n equals about 40 to 400, typically about 50). Commonly the aromatic polyester utilized in the present process has a chlorine and/or bromine content of about 15% to 60% by weight based upon the weight of the aromatic polyester (e.g., a chlorine and/or bromine content of about 25% to 50% by weight). As is apparent from the structural formula, the aromatic polyester is chlorinated and/or brominated in the sense that these substituents are directly attached to an aromatic ring. Preferably the halogen substituents are all bromine.

The halogenated aromatic polyesters conforming to the above-defined formula may be prepared in high molecular weight by either interfacial polymerization or solution polymerization techniques as described in U.S. Pat. No. 3,234,167 which is hereby incorporated by reference. The solution polymerization method is preferred and will be described in detail herein. In this solution polymerization method, substantially equimolar amounts of (1) an appropriate bisphenol, and (2) a diacid halide such as isophthaloyl chloride, terephthaloyl chloride, or mixtures thereof are reacted.

Initially the appropriate bisphenol is dissolved in a suitable solvent. A catalyst or acid acceptor is also dissolved in the solvent prior to the addition of the diacid halide.

The bisphenols which are useful in the preparation of the polyesters having recurring units of the formula illustrated above have the structure:

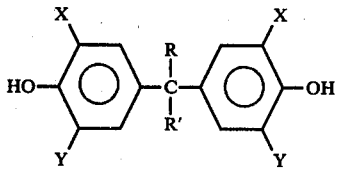

where X, Y, R and R' have the same significance as set forth hereinabove. Suitable bisphenols which are useful in the practice of this invention include bis(3,5-dibromo-4-hydroxyphenyl)methane; bis(3,5-dichloro-4-hydroxyphenyl)methane; bis(3-chloro-5-bromo-4-hydroxyphenyl)methane; 1,1-bis(3,5-dibromo-4-hydroxyphenyl)ethane; 1,1-bis-(3,5-dichloro-4-hydroxyphenyl)ethane; 1,1-bis-(3-chloro-5-bromo-4-hydroxyphenyl)ethane; 1,1-bis-(3,5-dibromo-4-hydroxyphenyl)- propane; 1,1-bis-(3,5-dichloro-4-hydroxyphenyl)propane; 1,1-bis-(3-chloro-5-bromo-4-hydroxyphenyl)propane; 2,2-bis-(3,5-dibromo-4-hydroxyphenyl)propane; 2,2-bis-(3,5-dichloro-4-hydroxyphenyl)propane; 2,2-bis-(3-chloro-5-bromo-4-hydroxyphenyl)propane; bis-(3-bromo-4-hydroxyphenyl)methane; bis-(3-chloro-4-hydroxyphenyl)methane; 3-bromo-3'-chloro-bis(4-hydroxyphenyl)methane; 1,1-bis-(3-bromo-4-hydroxyphenyl)ethane; 1,1-bis-(3-chloro-4-hydroxylphenyl)ethane; 3-bromo-3'-chloro-bis-(4,4'-hydroxyphenyl)ethane; 1,1'-bis-(3-bromo-4-hydroxyphenyl)propane; 1,1'-bis(3-chloro-4-hydroxyphenyl)propane; 1,1'-(3-chloro-3'-bromo-bis-[4,4'-hydroxyphenyl])propane; 2,2'-bis-(3-bromo-4-hydroxyphenyl)propane; 2,2'-bis-(3-chloro-4-hydroxyphenyl)propane; 2,2'-(3-bromo-3'-chloro-bis[4,4'-hydroxyphenyl])-propane; as well as their alkali metal salts.

Preferred bisphenols are 2,2-bis-(3,5-dibromo-4-hydroxyphenyl)propane, also known as tetrabromobisphenol A, and 2,2-bis-(3,5-dichloro-4-hydroxyphenyl)-propane, also known as tetrachlorobisphenol A.

Many brominated bisphenols of the above-described structure are commercially available and may be prepared by the condensation of a lower alkyl ketone or aldehyde with two molecules of the phenol and subsequently brominating and/or chlorinating the unsubstituted phenol. This reaction is usually carried out with or without an inert solvent in the presence of an acid. This reaction is summarized in the case of X and Y being bromine in the following equations wherein R and R' have the meanings hereinabove described.

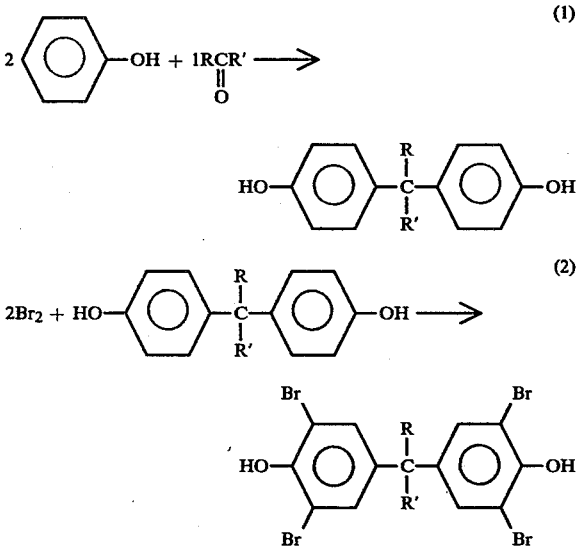

The solvent in which the bisphenol and catalyst or acid acceptor are dissolved and in which the reaction takes place should be inert and incapable of reacting with any of the components present therein. Furthermore, the solvent should be a solvent for both the starting materials as well as the resulting polymer. This allows the solvent to help maintain the forming polymer in a more workable form.

Suitable solvents which may be utilized in the solution polymerization technique described herein include chloroalkanes and aromatic and chloroaromatic compounds. Examples of such compounds include methylene chloride, chloroform, tetrachloroethane, trichloroethane, chlorobenzene, chlorotoluene, dichloroethane, benzene, toluene, and xylene.

The catalyst or acid acceptor is preferably a tertiary amine which is capable of undergoing a reaction with the bisphenol to form a complex salt. The bisphenol complex salt subsequently reacts with the diacid halide and liberates an amine halide.

Stoichiometric amounts of the bisphenol and the catalyst would require a ratio of the tertiary amine to the bisphenol of about 2:1. However, it has been found that in order for the reaction to proceed at a commercially acceptable rate, an excess of acid acceptor should be employed. The amount of excess acid acceptor is generally less than about 50, typically less than about 20 and preferably less than about five percent of the acid acceptor based upon the stoichiometric amount of acid acceptor required. The upper limit of acid acceptor is not critical. However, it should be remembered that excess amounts of acid acceptor must be neutralized and the reaction product of the neutralization reaction must be separated from the final polymer product.

Representative examples of suitable tertiary amine catalysts or acid acceptors include triethylamine, diamino-2,2,2,bicyclo octane, tripropyl amine, dimethyl aniline, pyridine, dimethyl amine and benzyl amine. Triethylamine is a preferred acid acceptor.

It will be noted that halogenated aromatic polyesters are prepared by the condensation of bisphenols with the diacid halides of isophthalic acid, terephthalic acid or mixtures thereof. The use of a diacid halide as opposed to other corresponding derivatives is important in that it is normally not possible to directly prepare these polymers from bisphenols and free acids. These acid halides may be derived from the corresponding dicarboxylic acids by any one of several methods well known in the art such as by reacting the respective acids with thionyl chloride. Thus, the diacid halide is preferably utilized in the form of a diacid chloride.

It is generally preferred to dissolve the diacid halide in the same type of solvent utilized to prepare the solution containing the halogenated bisphenol. Although this is not critical, the employment of a solvent provides for a more accurate control of the addition of the diacid halide to the bisphenol containing solution.

In preparing a preferred brominated aromatic polyester, the diacid halide will generally be utilized in the form of an aromatic acid chloride mixture of from about 45 to about 75%, preferably from about 55 to about 65% (e.g., 60%) by weight isophthaloyl chloride, and correspondingly from about 25 to about 55%, preferably from about 35 to about 45% (e.g., 40%) by weight terephthaloyl chloride.

In preparing a preferred chlorinated aromatic polyester, the diacid halide will generally be utilized as an aromatic acid chloride mixture of from about 40 to about 90%, preferably from about 60 to about 80% (e.g., 70%) by weight isophthaloyl chloride, and correspondingly from about 10 to about 60%, and preferably from about 20 to about 40% (e.g., 30%) by weight terephthaloyl chloride.

For smooth operation in a stirred solution, the resulting polymer product preferably should be about 10% or less on the basis of the total weight of the solvent although percentages as high as 25% may be utilized depending upon the molecular weight of the polymer.

Generally substantially stoichiometric amounts of each reactant are employed. Typical molar amounts of from about 1:0.9:0.1 to about 1:0.4:0.6, of the ratio of bisphenol, isophthaloyl chloride, and terephthaloyl chloride, respectively, may be utilized when preparing a chlorinated aromatic polyester. Typical molar amounts of from about 1:0.45:0.55 to about 1:0.75:0.25 of the ratio of bisphenol, isophthaloyl chloride, and terephthaloyl chloride, respectively, may also be utilized when preparing a brominated aromatic polyester.

The polymerization reaction may be carried out in a batch, semi-continuous, or continuous manner, as desired. However, in a preferred embodiment, the reaction is carried out in a continuous manner, by which the reactants are continuously introduced into the reaction zone and the polymer product is continuously prepared and withdrawn. This may be achieved, for example, by utilizing a cylindrical tube, having static mixers as a reaction vessel. The bisphenol containing solution is passed through the tube while adding the diacid halide at various points along the longitudinal axis of the tube. Thus, the diacid halide is added in large amounts at the upstream portion of the tube and in gradually decreasing amounts at positions further downstream in the tube.

The final concentration of the polymer in solution is generally from about 3 to about 25, typically from about 5 to about 20, and preferably from about 7 to about 15 percent by weight of the total reaction mixture. At these concentrations, the solution viscosity will generally vary from about 1 to about 3000 poise, typically from about 5 to about 2000 poise, and preferably from about 10 to about 1000 poise.

Polymerization is effected at temperatures which may vary from about 0 to about 200, typically from about 10 to about 100, and preferably from about 15° to about 50° C., and at corresponding autogenous pressures which are due to the vapor pressure of the solvent at the aforenoted temperatures which may vary from about 0.2 to about 26, typically from about 0.3 to about 4.8, and preferably from about 4.0 to about 1.4, atmospheres.

Agitation of the reactants should be sufficient to evenly disperse the diacid halide throughout the bisphenol containing solution to avoid a build-up of the concentration of the diacid halide in a localized area within the reaction mixture. Such agitation may be supplied by any of the standard means of mixing such as by stirrer, shaker, static mixer, spray nozzle or other flow agitating systems.

The present process typically employs reaction times of generally from about 0.1 to about 20, typically from about 1 to about 10, and preferably from about 2 to about 6, hours when conducted on a batch basis. Polymerization conducted on a continuous basis will typically employ shorter polymerization times depending on the degree of mixing.

At the conclusion of the polymerization reaction, the polymer solution which contains tertiary amine hydrochloride and unreacted tertiary amine must be treated with hydrogen chloride to neutralize the unreacted tertiary amine. This hydrogen chloride may be in the form of an aqueous hydrochloric acid solution, or, in a preferred embodiment as disclosed in copending patent application U.S. Ser. No. 208,366 now U.S. Pat. No. 4,322,521, filed concurrently herewith by Albert G. Williams entitled "Improved Process for Preparing Halogenated Aromatic Polyesters", the hydrogen chloride may be introduced in the form of gaseous, substantially anhydrous, hydrogen chloride. The disclosure of the above-identified patent application is hereby incorporated by reference.

After the neutralization of the tertiary amine, the tertiary amine hydrochloride is removed from the polymer containing solution. This may be accomplished by multiple batch extractions with water or preferably, by employing the continuous countercurrent extraction method disclosed in copending patent application U.S. Ser. No. 208,201, entitled "Continuous Countercurrent Extraction Process For Removing Water Soluble Impurities From Polymer Solutions", filed concurrently herewith by Albert G. Williams. The disclosure of this patent application is hereby incorporated by reference.

After removal of the water-soluble impurities, the halogenated aromatic polyester may be recovered in any suitable manner such as evaporation of the solvent or by precipitation of the polymer in a suitable non-solvent such as acetone or methanol. The polymer may then be isolated in solid form and dissolved in a suitable solvent at a concentration sufficient to achieve the desired spinning dope viscosity or concentrated without isolation to the desired spinning dope viscosity by employing the method disclosed in copending patent application U.S. Ser. No. 208,202, entitled "Flash Evaporation Process for Concentrating Polymer Solutions", filed concurrently herewith by Albert G. Williams, and thereafter processed for shaping. The disclosure of this patent application is hereby incorporated by reference.

The polyester is dissolved in the spinning solvent at a concentration of generally from about 10 to about 30, typically from about 15 to about 25, and preferably from about 20 to about 22% by weight of the solution to form a solution which has a viscosity of generally from about 300 to about 5000, typically from about 600 to about 3000, and preferably from about 1000 to about 2000, poise.

The polymer solution is then dry spun according to the process of the present invention. The spinning composition is prepared by dispersing an oxide of antimony within the solution of halogenated aromatic polyester and solvent. The oxide of antimony can either be antimony trioxide (i.e., $Sb_2O_3$), antimony pentoxide (i.e., $Sb_2O_5$), or mixtures thereof.

The dispersions of antimony oxide may be prepared, for example, by mixing about 25 parts antimony oxide, about 5 parts dry polymer of the same composition as that used to prepare the spinning solution, and about 70 parts methylene chloride in a ball mill, or other typical dispersion apparatus to disperse the antimony oxide to its finest particle size. The resultant viscous slurry is then added to the already prepared polymer solution in the mixer which was used to prepare the initial polymer solution, in a quantity such that the amount of oxide of antimony is provided in the final fiber in a concentration of generally from about 0.1 to about 20, and preferably from about 0.4 to 10, precent by weight oxide of antimony based upon the weight of the halogenated aromatic polyester.

The clogging problem is reduced, of course, as the level of antimony oxide is reduced until there is essentially no clogging problem at 0% antimony oxide.

When antimony trioxide is employed, it has an average size of about 2 microns but the individual particle size may vary from about 0.5 to about 6 microns. In a preferred embodiment of the present invention, there may be employed a fine particle size antimony trioxide which is 100% powder having an average particle size of about 0.1 micron. This particular antimony trioxide is prepared by Chemetron, Inc.

Another antimony oxide which is particularly useful in the process of the present invention is colloidal antimony trioxide which has a particle size of 2 to 50 and preferably 5 to 30, nanometers. This colloidal antimony trioxide is described in U.S. Pat. No. 3,718,584. The disclosure of this patent is hereby incorporated by reference.

The particle size of the antimony oxide particles may be determined by any method known to those having ordinary skill in this art. For example, a suspension of the particles in "Isoton" solution, a solution of 1% sodium chloride in water, may be passed through capillary tubes and the resistance of the solution in the tube may be measured as a function of capillary size using a Coulter counter. Alternatively, the particle size may be determined by the well-known BET (Brunauer, Emmett, and Teller) method.

The polymer solution may be dry-spun into an evaporative atmosphere for the methylene chloride solvent to form filaments. The stable solution can, for example, be extruded into an atmosphere of heated air. It is preferred that no steam or other moisture be present in the evaporative atmosphere.

Spinning of the polymer solution may be performed using any suitable dry-spinning apparatus. Both downdraft and updraft spinning columns may be used under either heated or cool column conditions. A typical spinning column may be about 6 inches in diameter and 6 to 25 feet long.

The polymer solution may be spun through an opening into the spinning column. Often, the spinneret may be provided with a jet having multiple openings (e.g., up to about 300 holes or more) although a single opening may be satisfactory. Each opening is generally of the same size and must each have a diameter of at least about 60, generally from about 60 to about 200, typically from about 65 to about 150, and preferably from about 75 to about 125, microns.

A hole size larger than about 200 microns will result in fibers which have significantly poorer properties and which are significantly less uniform than if the smaller size hole is used. However, the upper limit for hole size is to some extent determined by the viscosity of the dope, the temperature at which spinning is carried out, the tensile properties of the resultant yarn, etc. A hole size smaller than about 60 microns would result in the spinneret clogging within a commercially unacceptably short period of time.

The spinnerets typically include round holes having single, double or triple conical entries, constant acceleration entry, hyperbolic entry, or holes having shaped cross sections, such as X, Δ, K, Y shapes, etc. Preferred spinnerets useful in the present invention are described in U.S. Pat. No. 4,015,924 which is assigned to the assignee of the present invention. The disclosure of this patent is hereby incorporated by reference.

The temperatures of the spinning solution inside the spinneret may range, for example, from about 30° to about 100° C., and the evaporative medium near the top of the column at from about 30° to about 130° C., and near the bottom of the column at from about 30° to about 150° C.

Conventional spinnerets for spinning halogenated aromatic polyesters have diameters of up to about 50, typically from about 36 to about 44, microns.

It has been found, for example, that when a composition comprising 1.28% by weight antimony trioxide, which has an average diameter of two microns, 19.74% by weight condensation product of tetrabromobisphenol A and a mixture of 60% by weight isophthaloyl chloride and 40% by weight terephthaloyl chloride, and 78.97% by weight methylene chloride is spun in a 20 hole 50 micron CAE tantalum spinneret, there is a rapid pressure buildup on the spinning jets such that after about 30 minutes, the jets are substantially completely clogged and further spinning is impossible. However, when that same composition is passed through a 20 hole 76 micron CAE tantalum spinneret, there is no substantial clogging of the jets for up to 24 hours.

The theoretical explanation of the above phenomenon is not yet clear. However, it is believed that clogging of the spinneret jets does not occur solely by means of an agglomeration mechanism, i.e., by an agglomeration of several antimony oxide particles. Agglomeration alone is not a sufficient explanation of the problem of clogging because mere agglomeration of antimony oxide particles would show a sudden step increase in the pressure in the spinneret cup. However, it has been found that no such pressure increase takes place. Rather an initial slow build up in pressure is followed by a rapid pressure increase only when the jet hole becomes clogged. Furthermore, increasing the jet hole size from 50 to 76 microns increases the hole area by a factor of only 2.3 whereas the spinning time is increased by a factor of 50 or more.

The clogging is believed to be related in some way to the electrostatic charge on the antimony oxide particles. This charge may vary depending upon the method of preparation of the antimony oxide particles, the concentration of antimony oxide in the spinning solution, the conductivity of the solution, and the shear rate of the dope through the spinneret holes.

As noted hereinabove, in a preferred embodiment of the present invention, the fine particle size antimony trioxide produced by Chemetron, Inc. is used as the oxide of antimony. This antimony trioxide has an average particle size of about 0.1 micron and is 100% powder. When this small particle size antimony trioxide is employed in an accelerated test with 50 micron jets, the spinning life of the jets may be extended by a factor of generally at least about 6, and typically at least about 20, over the spinning life of the jets when two micron antimony trioxide is employed.

The as-spun textile denier of the filaments produced by the present process may be generally from about 1 to about 60, typically from about 2 to about 36, and preferably from about 6 to about 24 denier per filament.

After spinning in accordance with the present invention, the halogenated aromatic polyester fibers may be drawn in order to produce fibers having improved tensile properties. A preferred method of drawing these fibers is disclosed in copending patent application U.S. Ser. No. 208,364, entitled "Improved Process for Drawing Halogenated Aromatic Polyester Fibers", filed concurrently herewith by Albert G. Williams. This process comprises drawing the fibers at a draw ratio of from about 3:1 to about 10:1 and a temperature of from about 315° to about 355° C. to produce fibers having improved tensile properties. The disclosure of the above-identified patent application is hereby incorporated by reference.

The as-spun filaments may be drawn generally from about 1.5 to about 10, preferably from about 3 to about 6, times in length to a final denier of generally from about 1 to about 10, preferably from about 2 to about 6, denier per filament.

The solvent resistance of the halogenated aromatic polyester fibers, whether drawn or not, may be improved by heat treating the fibers at constant length at a temperature of from about 270° to about 295° C. for from about 5 to about 60 minutes. This process is described in detail in copending patent application U.S. Ser. No. 208,363, entitled "Solvent Resistant Halogenated Aromatic Polyester Fibers and Process Therefor", filed concurrently herewith by Albert G. Williams. The disclosure of this patent application is hereby incorporated by reference.

The solvent resistance of these polymers may be further improved by treating the fibers with boiling perchloroethylene for a period of at least about 15 minutes as disclosed in detail in copending patent application U.S. Ser. No. 208,204, entitled "Solvent Resistant Halogenated Aromatic Polyester Fibers and Process Therefor," filed concurrently herewith by Alex S. Forschirm and Arnold J. Rosenthal. The disclosure of this patent application is hereby incorporated by reference.

The halogenated aromatic polyester fibers described herein have been used to produce a number of inherently nonburning fibrous materials which are particularly advantageous when fibrous articles are required for use in fire-control environments, such as children's sleepwear, suits for fire fighters, hospital furnishings, and uniforms for military and civilian personnel.

The following Examples are given as specific illustrations of the claimed invention. It should be understood, however, that the invention is not limited to the specific details set forth in the Examples. All parts and percentages in the Examples as well as in the remainder of the specification are by weight unless otherwise specified.

EXAMPLES 1-3

Two-hundred one and seven-tenths parts by weight tetrabromobisphenol A, 45.2 parts by weight isophthaloyl chloride and 30.1 parts by weight terephthaloyl chloride are reacted to form a brominated aromatic polyester in the presence of about 2600 parts by weight methylene chloride solvent and 77.3 parts by weight of triethylamine acid acceptor.

The contents of the reaction zone are heated at atmospheric pressure at about 40° C. with agitation for 3 hours. The resulting polymer has a medium intrinsic viscosity of about 0.8 dl/gm as determined from a 0.1% solution of the polymer at 25° C. in a 10/7 (w/w) phenol/trichlorophenol solution. This polymer is employed for Runs 1 & 2 at Table I. The above procedure is repeated with the exception that a polymer of high intrinsic viscosity i.e., 1.2 dl/gm, determined as discussed above, is obtained. This polymer is employed in Run 3.

When the reaction is complete, substantially anhydrous hydrogen chloride is bubbled through a gas sparge into the solution for five minutes until the excess triethylamine acid acceptor is neutralized as determined by measuring the pH of the solution. Neutralization is complete when the pH is reduced to less than about 3.0. The pH is determined by removing a small portion of the dope and measuring the pH of the aqueous layer of a mixture of 50/50 (w/w) dope with distilled water.

The reaction mixture is then washed with water until a pH of 6 is achieved. The resulting brominated polyester is recovered by precipitation with methanol.

The brominated aromatic polyester is dissolved in a methylene chloride spinning solvent at the concentration indicated hereinbelow to yield a solution having the viscosities indicated hereinbelow. A slurry is prepared from 24.6 parts antimony trioxide having an average particle diameter of two microns (containing a mixture of particles having a diameter range of from about 0.5 to about 6 microns, i.e., N. L. Industries "White Star" grade), 5.2 parts by weight of the brominated aromatic polyester and 70.2 parts by weight of methylene chloride. This slurry is ball milled for sufficient time to reduce the agglomeration of the antimony trioxide. A quantity of this mixture to provide 6.5% by weight antimony trioxide on the weight of the polymer is added to the polymer solution and thoroughly mixed therein. The solution is filtered, deaerated, and dry spun through an appropriate dry spinning jet under the conditions specified in Table I below.

TABLE I

| Run No. | 1 | 2 | 3 |
|---|---|---|---|
| Dope Solids, % by weight | 21.4 | 21.5 | 20.5 |
| Dope Viscosity, Poise | 1035 | 1050 | 1664 |
| Jet (No. of Holes/hole size) (microns) | 40/75 | 50/75 | 20/76 |
| Dope Temperature in Jet, °C. | 85 | 72 | 85 |
| Jet Face Temperature, °C. | 75 | 66 | 73 |
| Column Temperature, °C. Top | 54 | 52 | 55 |
| Column Temperature, °C. Bottom | 86 | 85 | 85 |
| Take-up Speed meters/min. | 100 | 100 | 125 |
| Column Length, feet | 23 | 23 | 23 |
| Column Air, CFM | 15 | 15 | 15 |
| Spinning Time (hours) | 11 | 9 | 24 |
| Jet Hole Blockage, % of area | 20 | 0.7 | 0.2 |
| Pressure Drop Increase Across Jet, psig | 36 | 10 | <10 |

Spinning is continued for the stated spinning time without substantial clogging.

COMPARATIVE EXAMPLE A

Example 1 is repeated using 50 micron diameter holes in the spinneret. After 30 minutes, 43% of the hole area of the spinneret is blocked and the pressure drop across the jet increases by 175 psig.

COMPARATIVE EXAMPLE B

Example 1 is repeated using 50 micron diameter holes in the spinneret. Furthermore, the spinning solution contains no antimony oxide.

The spinning is discontinued after 44 hours with 3.5% jet hole area blockage and essentially no pressure increase across the jet.

COMPARATIVE EXAMPLE C

Example 1 is repeated using fine particle size (an average particle size of about 0.1 micron) antimony trioxide prepared by Chemetron Inc. and described hereinabove. The spinneret holes have a diameter of 50 microns. No deposits or pressure buildup are noted after four hours of spinning.

The results of this Comparative Example should be compared with those of Comparative Example A wherein 43% of the hole area of the spinneret is blocked and the pressure drop across the jet increases by 175 psig after only 30 minutes of spinning.

Thus, these Comparative Examples illustrate the advantages associated with the use of this fine particle size antimony trioxide over the use of antimony trioxide having an average particle diameter of two microns. These same advantages are obtainable when the spinneret hole diameter is within the scope of the presently claimed invention.

The above-described Comparative Examples have all been carried out using 50 micron diameter spinnerets for the purpose of test acceleration.

COMPARATIVE EXAMPLE D

Example 1 is repeated using Nyacol AP-50 (a colloidal antimony pentoxide) and a 46 micron jet hole. After 7 hours of spinning, there is no pressure buildup and only 1.5% jet deposit. However, when the yarn is drawn over a hot shoe, it discolors and has low tensile properties.

This Comparative Example illustrates that when this particular antimony pentoxide is employed, the problem of spinneret clogging does not exist. However, because of the presence of the Ethomeen dispersion stabilizer within this antimony pentoxide, the polyester discolors and fuses upon drawing.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in this art without departing from the spirit of the invention.

I claim:

1. An improved process for dry spinning into fiber a composition consisting essentially of a halogenated aromatic polyester having recurring units of the structural formula:

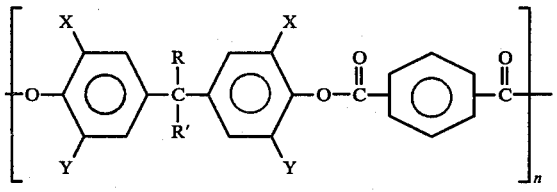

wherein X, which may be the same or different, may be chlorine or bromine, Y, which may be the same or different, may be hydrogen, chlorine, or bromine, R and R′ may be the same or different and represent lower alkyl groups, hydrogen, or together constitute a cyclic hydrocarbon group, and n equals at least 10, and an oxide of antimony, said process comprising spinning said composition through a spinneret having one or more holes which have a diameter of from about 60 to about 200 microns.

2. The process of claim 1 wherein R and R′ may contain from 1 to about 5 carbon atoms and wherein n may be from about 40 to about 400.

3. The process of claim 2 wherein said halogenated aromatic polyester is the condensation product of tetrabromobisphenol A and an aromatic diacid chloride mixture of from about 45 to about 75 percent by weight isophthaloyl chloride and correspondingly from about 55 to about 25 percent by weight terephthaloyl chloride.

4. The process of claim 3 wherein the aromatic diacid chloride mixture comprises 60 percent by weight isophthaloyl chloride and 40 percent by weight terephthaloyl chloride.

5. The process of claim 1 wherein said oxide of antimony is antimony trioxide.

6. The process of claim 1 wherein said oxide of antimony is antimony pentoxide.

7. An improved spinning process for a composition comprising antimony trioxide having an average particle diameter of about 0.1 micron and halogenated aromatic polyesters which have recurring units of the structural formula:

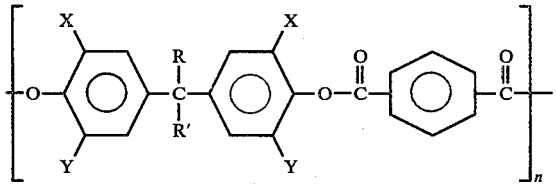

wherein X, which may be the same or different, may be chlorine or bromine, Y, which may be the same or different, may be hydrogen, chlorine, or bromine, R and R′ may be the same or different and represent alkyl groups having from 1 to about 5 carbon atoms, hydrogen, or together constitute a cyclic hydrocarbon group, and n is from about 40 to about 400, said process comprising spinning said composition through a spinneret having one or more holes which each have a diameter of from about 65 to about 150 microns.

8. The process of claim 7 wherein said halogenated aromatic polyester is the condensation product of tetrabromobisphenol A and an aromatic diacid chloride mixture of from about 45 to about 75 percent by weight isophthaloyl chloride and correspondingly from about 55 to about 25 percent by weight terephthaloyl chloride.

9. The process of claim 8 wherein the aromatic diacid chloride mixture comprises 60 percent by weight isophthaloyl chloride and 40 percent by weight terephthaloyl chloride.

* * * * *